US005965470A

United States Patent [19]

Bening et al.

[11] Patent Number: 5,965,470

[45] Date of Patent: Oct. 12, 1999

[54] COMPOSITES CONTAINING SURFACE TREATED CARBON MICROFIBERS

[75] Inventors: Robert C. Bening, Sunderland; Thomas J. McCarthy, Amherst, both of Mass.

[73] Assignee: Hyperion Catalysis International, Inc., Cambridge, Mass.

[21] Appl. No.: 08/447,948

[22] Filed: May 23, 1995

Related U.S. Application Data

[62] Division of application No. 08/329,774, Oct. 27, 1994, which is a continuation of application No. 08/117,873, Sep. 7, 1993, abandoned, which is a continuation of application No. 07/823,021, Jan. 15, 1992, abandoned, which is a continuation of application No. 07/351,967, May 15, 1989, abandoned.

[51] Int. Cl.[6] ..... B32B 9/00

[52] U.S. Cl. ..... 501/95.1; 501/95.2; 423/460; 423/447.1; 423/447.2; 428/367; 428/398; 428/376; 428/457; 428/688; 524/424

[58] Field of Search ..... 501/95, 95.1, 95.2; 423/460, 447.1, 447.2; 8/115.51, 115.6; 428/364, 367, 398, 376, 408, 426, 457, 688, 473.5, 480, 492; 524/424

[56] References Cited

U.S. PATENT DOCUMENTS

| | | | |
|---|---|---|---|
| 3,746,560 | 7/1973 | Goan et al. | 423/447.1 |
| 3,964,952 | 6/1976 | Brié et al. | 423/447.1 |
| 3,989,802 | 11/1976 | Joo et al. | 423/447.1 |
| 4,009,305 | 2/1977 | Fujimaki et al. | 423/447.1 |
| 4,284,615 | 8/1981 | Maruyama | 423/447.1 |
| 4,388,289 | 6/1983 | Shepherd et al. | 423/447.2 |
| 4,663,230 | 5/1987 | Tennant | 428/367 |
| 4,816,289 | 3/1989 | Komatsu et al. | 423/447.3 |
| 4,855,122 | 8/1989 | Kitamura et al. | 423/447.1 |

FOREIGN PATENT DOCUMENTS

| | | | |
|---|---|---|---|
| 2178748 | 5/1972 | France | 423/447.1 |
| 56-160311 | 12/1981 | Japan | 423/460 |
| 61-225325 | 10/1986 | Japan . | |
| 61-225326 | 10/1986 | Japan . | |
| 62-263377 | 11/1987 | Japan . | |
| 62-276082 | 11/1987 | Japan . | |
| 63-286468 | 11/1988 | Japan . | |
| 9922 | 5/1892 | United Kingdom | 423/448 |
| WO 87/07559 | 12/1987 | WIPO . | |

OTHER PUBLICATIONS

"Carbon Fibers" *Carbon,* vol. 2, pp. 640–663 (Date unknown).

Baker, R.T.K., "Catalytic Growth of Carbon Filaments" Carbon 27, pp. 315–323 (1989); (no month).

*Primary Examiner*—Michael Marcheschi

*Attorney, Agent, or Firm*—Whitman Breed Abbott & Morgan LLP

[57] ABSTRACT

A method of oxidizing the surface of carbon microfibers that includes contacting the microfibers with an oxidizing agent that includes sulfuric acid and potassium chlorate under reaction conditions sufficient to oxidize the surface. The invention also features a method of decreasing the length of carbon microfibers that includes contacting the microfibers with an oxidizing agent under reaction conditions sufficient to decrease the length.

20 Claims, No Drawings

COMPOSITES CONTAINING SURFACE TREATED CARBON MICROFIBERS

This application is a division of application Ser. No. 08/329,774, filed Oct. 27, 1994, which is a Continuation of Ser. No. 08/117,873, filed Sep. 7, 1993, abandoned which is a Continuation of Ser. No. 07/823,021, filed Jan. 15, 1992, abandoned which is a Continuation of Ser. No. 07/351,967, filed May 15, 1989 abandoned.

BACKGROUND OF THE INVENTION

This invention relates to modifying the surface of carbon microfibers.

Carbon microfibers (i.e. fibers having very small diameters, typically less than 1 micron) are known. Microfibers having diameters less than 0.5 micron are often referred to as fibrils. Examples of such microfibers and methods for preparing them are described in Tennent, U.S. Pat. No. 4,663,230 ("Carbon Fibrils, Method for Producing Same and Compositions Containing Same"); Tennent et al., U.S. Ser. No. 06/871,676 ("Novel Carbon Fibrils, Method for Producing Same and Compositions Containing Same") filed Jun. 6, 1986, now abandoned, refiled as continuation application Ser. No. 07/593,319, filed Oct. 1, 1990, now U.S. Pat. No. 5,165,909, issued Nov. 24, 1992; Tennent et al., U.S. Ser. No. 06/871,675 ("Novel Carbon Fibrils, Method for Producing Same and Encapsulated Catalyst") filed Jun. 6, 1986, now abandoned, refiled as continuation application Ser. No. 07/492,365, filed Mar. 9, 1990, now U.S. Pat. No. 5,171,560, issued Dec. 15, 1992; Snyder et al., U.S. Ser. No. 07/149,153 ("Carbon Fibrils") filed Jan. 28, 1988, now abandoned, refiled as continuation application Ser. No. 07/494,894, filed Mar. 13, 1990, refiled as continuation application Ser. No. 07/694,244, filed May 1, 1991; and Mandeville et al., U.S. Ser. No. 07/285,817, filed Dec. 16, 1988 ("Fibrils") refiled as continuation application Ser. No. 07/746,065, filed Aug. 12, 1991, refiled as continuation application Ser. No. 08/284,855, filed Aug. 2, 1994, all of which are assigned to the same assignee as the present application and are hereby incorporated by reference.

SUMMARY OF THE INVENTION

In a first aspect, the-invention features a method of oxidizing the surface of carbon microfibers that includes contacting the microfibers with an oxidizing agent that includes sulfuric acid ($H_2SO_4$) and potassium chlorate ($KClO_3$) under reaction conditions (e.g., time, temperature, and pressure) sufficient to oxidize the surface.

In a second aspect, the invention features a method of decreasing the length of carbon microfibers that includes contacting the microfibers with an oxidizing agent under reaction conditions (e.g., time, temperature, and pressure) sufficient to decrease the length by chopping the microfibers. Preferably, the oxidizing agent includes sulfuric acid and potassium chlorate.

In preferred embodiments, the oxidizing agent is in the liquid phase. The microfibers preferably have diameters no greater than 1 micron (more preferably no greater than 0.1 micron). Even more preferred are microfibers having diameters between 3.5 and 75 nanometers, inclusive. Particularly preferred are microfibers that are tubes having graphitic layers that are substantially parallel to the microfiber axis. One aspect of substantial parallelism is that the projection of the graphite layers on the microfiber axis extends for a relatively long distance in terms of the external diameter of the microfiber (e.g., at least two microfiber diameters, preferably at least five diameters), as described in Tennent et al., U.S. Ser. No. 07/149,573. These microfibers preferably are also free of a continuous thermal carbon overcoat (i.e. pyrolytically deposited carbon resulting from thermal cracking of the gas feed used to prepare the microfibers).

The microfibers prepared according to the above-described process may be incorporated in a matrix. Preferably, the matrix is an organic polymer (e.g., a thermoset resin such as epoxy, bismaleimide, polyimide, or polyester resin; a thermoplastic resin; a reaction injection molded resin; or an elastomer such as natural rubber, styrene-butadiene rubber, or cis-1,4-polybutadiene), an inorganic polymer (e.g., a polymeric inorganic oxide such as glass), a metal (e.g., lead or copper), or a ceramic material (e.g., Portland cement). The microfibers may also form an adsorbent or a polymerization initiator.

The invention also features a volume of carbon fibrils that includes a multiplicity of fibrils having a morphology consisting of tubes that are free of a continuous thermal carbon overcoat and have graphitic layers that are substantially parallel to the fibril axis, the outer surface of the graphitic layers having bonded thereto a plurality of oxygen-containing groups (e.g., a carbonyl, carboxylic acid, carboxylic acid ester, epoxy, vinyl ester, hydroxy, alkoxy, isocyanate, or amide group), or derivatives thereof (e.g., a sulfhydryl, amino, or imino group).

The invention provides a simple and effective method for introducing, through an oxidation reaction, a wide variety of functional groups onto the surface of microfibers. Moreover, the treatment does not leave heavy metal residues on the surface of the microfibers. The invention also effectively reduces microfiber length by "chopping up" the microfibers. Reducing the length aids in decreasing microfiber entanglement, thereby improving the tractability and dispersibility of the microfibers, two properties which are desirable in composite fabrication.

Other features and advantages of the invention will be apparent from the following description of the preferred embodiments thereof, and from the claims.

DESCRIPTION OF THE PREFERRED EMBODIMENTS

Preferred microfibers for the oxidation treatment are carbon fibrils having small diameters (preferably between 3.5 and 75 nanometers) and graphitic layers that are substantially parallel to the fibril axis that are also substantially free of a continuous thermal carbon overcoat, as described in Tennent, U.S. Pat. No. 4,663,230; Tennent U.S. Ser. No. 07/593,319; Tennent et al., U.S. Ser. No. 07/492,365; Snyder et al., U.S. Ser. No. 07/694,244; and Mandeville et al., U.S. Ser. No. 07/285,817. These fibrils are prepared as described in the aforementioned patent and patent applications.

In general, the fibrils are oxidized by contacting them with a solution of potassium chlorate dissolved in concentrated sulfuric acid. The treatment is conducted at room temperature in air. The initial oxidation reaction creates oxygen-containing functional groups on the surface of the fibrils. Continued exposure to the oxidizing solution cleaves the fibrils, thereby reducing fibril length.

EXAMPLE 1 g of potassium chlorate was dissolved in 50 ml of concentrated sulfuric acid and added slowly to approximately 1–2 g of the above-described carbon fibrils. The oxidation reaction was then allowed to proceed in air for 30 min. Upon stirring, fibrils became suspended in the acidic medium, resulting in a black, gelatinous suspension. Close examination of a more dilute suspension revealed that the fibrils were not uniformly distributed but instead remained associated in clumps. At the end of the reaction, the fibrils were collected on a medium porosity (about 5 $\mu$m) frit and washed with about 500 ml each of deionized water (until the filtrate had a ph of about 7) and methanol. Following filtration, all of the fibrils appeared to be retained on the frit. The fibrils were then dried first in a SCHLENK® tube at 70° C. under vacuum (50 mtorr) and then at 180° C. under flowing nitrogen.

The above procedure was repeated except that the oxidation reaction was allowed to proceed for 24 hours. Following filtration, the filtrate was slightly dark and cloudy, indicating the presence of small particles. Filtration through a 0.22 $\mu$m Millipore filter resulted in removal of the particles, indicating an effective length between 5 and 0.2 $\mu$m. Thus, this second reaction resulted in chopped-up fibrils having reduced lengths.

Samples from both reactions were then analyzed for carbon and oxygen content to reveal the presence of oxygen-containing groups using XPS spectroscopy. The results, shown in Table I, below, indicate that the oxidation reaction introduces a significant change in the atomic composition. No residual sulfur, chlorine, or potassium was observed. Moreover, a control reaction using only sulfuric acid resulted in no significant change in the atomic composition.

TABLE I

| Sample | % Carbon | % Oxygen |
|---|---|---|
| Pre-oxidation | 98.4 | 1.6 |
| Oxidized 30 min. | 91.9 | 8.1 |
| Oxidized 24 h. | 90.7 | 9.3 |
| $H_2SO_4$, 30 min. | 98.1 | 1.9 |

Other embodiments are within the following claims.

We claim:

1. A composite comprising carbon microfibers in a matrix wherein the carbon microfibers have on an outer surface of the carbon microfiber a plurality of oxygen-containing groups or derivatives thereof.

2. The composite of claim 1 wherein said matrix comprises an organic polymer.

3. The composite of claim 1 wherein said matrix comprises an inorganic polymer.

4. The composite of claim 1 wherein said matrix comprises a metal.

5. The composite of claim 1 wherein said matrix comprises a ceramic material.

6. The composite of claim 1 wherein said matrix comprises an elastomer.

7. A composite according to claim 1. wherein the carbon microfibers comprises a multiplicity of fibrils having a fibril axis and a morphology consisting of tubes that are free of a continuous thermal carbon overcoat and have graphitic layers having a projection along the fibril axis, wherein the projection of the graphitic layers along the fibril axis extends at least two fibril diameters.

8. A composite according to claim 7, wherein the diameter of the fibrils is no greater than about 0.1 microns.

9. A composite according to claim 7, wherein the diameter of the fibrils is between about 3.5 and about 75 nanometers.

10. A composite according to claim 7, wherein the projection of the graphitic layers along the fibril axis extends at least 5 fibril diameters.

11. A composite according to claim 7, wherein the graphitic layers are parallel to the fibril axis.

12. A composite according to claim 11, wherein the oxygen-containing groups are selected from the group consisting of carbonyl, carboxylic acid, carboxylic acid ester, epoxy, vinyl ester, hydroxy, alkoxy, isocyanate, amide or derivatives thereof.

13. A composite comprising carbon fibrils in a matrix wherein the fibrils have a morphology consisting of tubes that are free of a continuous thermal carbon overcoat and have on an outer surface of the tubes a plurality of oxygen-containing groups or derivatives thereof, wherein the fibrils have a diameter no greater than about 0.1 microns.

14. A composite according to claim 13, wherein the diameter of the fibrils is between about 3.5 and about 75 nanometers.

15. A composite according to claim 13, wherein the oxygen-containing groups are selected from the group consisting of carbonyl, carboxylic acid, carboxylic acid ester, epoxy, vinyl ester, hydroxy, alkoxy, isocyanate, amide or derivatives thereof.

16. A composite according to claim 13, wherein said matrix comprises an organic polymer.

17. A composite according to claim 13, wherein said matrix comprises an inorganic polymer.

18. A composite according to claim 13, wherein said matrix comprises a metal.

19. A composite according to claim 13, wherein the carbon fibrils are prepared by introducing functional groups onto the surface of the carbon fibrils by contacting said carbon fibrils with an oxidizing agent that includes sulfuric acid and potassium chlorate to oxidize the surface of the carbon fibrils, for a period of time, at room temperature, insufficient to decrease the length of the carbon fibrils by chopping.

20. A composite according to claim 13, wherein the carbon fibrils are prepared by a method of decreasing a length of the carbon fibrils comprising contacting said carbon fibrils with an oxidizing agent, at room temperature, for a period of time sufficient to decrease the length of the fibrils by chopping.

* * * * *